US010176770B2

(12) United States Patent
Zhang

(10) Patent No.: US 10,176,770 B2
(45) Date of Patent: Jan. 8, 2019

(54) METHOD AND APPARATUS FOR CONTROLLING LIQUID CRYSTAL DISPLAY BRIGHTNESS AND LIQUID CRYSTAL DISPLAY DEVICE

(71) Applicants: HISENSE ELECTRIC CO., LTD., Qingdao (CN); HISENSE USA CORPORATION, Suwanee, GA (US); HISENSE INTERNATIONAL CO., LTD., Qingdao (CN)

(72) Inventor: Yuxin Zhang, Qingdao (CN)

(73) Assignees: HISENSE ELECTRIC CO., LTD., Shandong (CN); HISENSE USA CORPORATION GA (US); HISENSE INTERNATIONAL CO., LTD., Shandong (CN)

( * ) Notice: Subject to any disclaimer, the term of this patent is extended or adjusted under 35 U.S.C. 154(b) by 3 days.

(21) Appl. No.: 15/430,279

(22) Filed: Feb. 10, 2017

(65) Prior Publication Data

US 2018/0090082 A1 Mar. 29, 2018

(30) Foreign Application Priority Data

Sep. 28, 2016 (CN) ..... 2016 1 0861089

(51) Int. Cl.
*G09G 3/36* (2006.01)

(52) U.S. Cl.
CPC ... *G09G 3/3607* (2013.01); *G09G 2310/0237* (2013.01); *G09G 2320/0646* (2013.01)

(58) Field of Classification Search
CPC ..... G09G 3/3607; G09G 2310/0237; G09G 2320/0633; G09G 2320/064; G09G 2320/0646
See application file for complete search history.

(56) References Cited

U.S. PATENT DOCUMENTS

2010/0066752 A1 3/2010 Watanuki ..... 345/589
2010/0283802 A1* 11/2010 Jung ..... G09G 3/3426 345/690

(Continued)

FOREIGN PATENT DOCUMENTS

CN 1904993 A 1/2007
CN 101989415 A 3/2011

(Continued)

OTHER PUBLICATIONS

The Chinese First Examination Report of corresponding China patent application No. 201610861089.X, dated Apr. 27, 2018.

*Primary Examiner* — Tom Sheng
(74) *Attorney, Agent, or Firm* — J.C. Patents

(57) ABSTRACT

Embodiments of the present application provide a method and apparatus for controlling liquid crystal display brightness, and a liquid crystal display device. The method for controlling liquid crystal display brightness according to the present application determines a backlight adjustment rule according to a grayscale value distribution of an image signal and a first preset rule, adjusts a zoned backlight value corresponding to a zoned image data block according to the backlight adjustment rule, as well as drives and controls the backlight source brightness of the corresponding backlight zone by using the adjusted zoned backlight value, thereby adjusting the zoned backlight values for image signals of different grayscale value distributions by using different backlight adjustment rules, significantly improving the picture hierarchy of different image signals, and enhancing the displaying quality of the picture.

14 Claims, 13 Drawing Sheets

(56) References Cited

U.S. PATENT DOCUMENTS

| | | | | |
|---|---|---|---|---|
| 2011/0115829 | A1* | 5/2011 | Ito | G09G 3/3426 345/690 |
| 2011/0227940 | A1* | 9/2011 | Neal | G09G 3/3426 345/589 |
| 2011/0292018 | A1* | 12/2011 | Kubota | G09G 3/3426 345/211 |
| 2012/0044277 | A1* | 2/2012 | Adachi | G09G 3/3426 345/690 |
| 2012/0206513 | A1* | 8/2012 | Ueno | G09G 3/3413 345/697 |
| 2012/0319936 | A1* | 12/2012 | Tanaka | G09G 3/3426 345/102 |
| 2013/0265348 | A1* | 10/2013 | Onogi | G09G 5/10 345/691 |
| 2014/0055505 | A1* | 2/2014 | Ikeda | G09G 3/22 345/690 |
| 2015/0365621 | A1* | 12/2015 | Zhang | G09G 5/005 348/791 |
| 2017/0084232 | A1* | 3/2017 | Yang | G09G 3/3426 |
| 2017/0110064 | A1* | 4/2017 | Zhang | G09G 3/3406 |

FOREIGN PATENT DOCUMENTS

| | | | |
|---|---|---|---|
| CN | 105139809 | A | 12/2015 |
| CN | 105185327 | A | 12/2015 |
| CN | 105185328 | A | 12/2015 |

* cited by examiner

METHOD AND APPARATUS FOR CONTROLLING LIQUID CRYSTAL DISPLAY BRIGHTNESS AND LIQUID CRYSTAL DISPLAY DEVICE

CROSS REFERENCE TO RELATED APPLICATION

The present application claims the priority to Chinese patent application No. 201610861089.X, filed with the State Intellectual Property Office of China on Sep. 28, 2016, entitled "Method for Backlight Source Control, Apparatus for Backlight Source Control and Liquid Crystal Display Screen", the contents of which are hereby incorporated by reference in its entirety.

TECHNICAL FIELD

Embodiments of the present application relate to liquid crystal display technology, and in particular, to a method and apparatus for controlling liquid crystal display brightness, and liquid crystal display device.

BACKGROUND

The dynamic backlight modulation technology is commonly used in the liquid crystal display (LCD) for controlling the backlight brightness, thereby saving energy and improving quality of image effects, such as picture contrast. Wherein, the dynamic backlight modulation technology mainly includes multi-zone dynamic backlight modulation and global backlight modulation.

By the multi-zone dynamic backlight modulation, a backlight module of a liquid crystal display is, divided into a plurality of backlight zones, wherein a backlight source is set for each backlight zone, and the brightness of each backlight zone can be individually driven and controlled. In the multi-zone dynamic backlight modulation technology, a global image of each frame of a video signal is divided into a plurality of zoned image data blocks corresponding to the backlight zones, and the grayscale data of the zoned image data blocks obtained are collected to obtain a backlight value of the backlight zones corresponding to the zoned image data blocks, wherein the backlight value of each backlight zone represents the brightness difference among their corresponding zoned image data blocks, such that the backlight brightness of a backlight zone is determined by the grayscale brightness of the image data block corresponding to the backlight zone, and a brightness change of a backlight zone reflects a grayscale brightness change of the image data block corresponding to the backlight zone.

SUMMARY

In an aspect, embodiments of the present application provide a method for controlling liquid crystal display brightness, including:

determining a backlight adjustment rule according to a grayscale value distribution of an image signal and a first preset rule;

determining a zoned image data block according to the image signal and a preset division rule, and determining a zoned backlight value corresponding to the zoned image data block according to a grayscale value of the zoned image data block;

adjusting the zoned backlight value according to the backlight adjustment rule to obtain an adjusted zoned backlight value; and mapping the adjusted zoned backlight value, to a drive circuit of a backlight source of a corresponding backlight zone, so as to drive and control backlight source brightness of the corresponding backlight zone;

wherein a grayscale value distribution of the image signal represents a grayscale value distribution of pixels of the image signal, the first preset rule includes a corresponding relationship between the grayscale value distribution and the backlight adjustment rule, and the backlight adjustment rule is a corresponding relationship between the backlight value and an adjustment coefficient.

In another aspect, embodiments of the present application provide an apparatus for controlling liquid crystal display brightness, including: a memory, which is configured to store instructions; and a processor coupled to the memory, which is configured to execute the instructions stored in the memory, and also configured to:

determine a backlight adjustment rule according to a grayscale value distribution of an image signal and a first preset rule;

determine a zoned image data block according to the image signal and a preset division rule, and determine a zoned backlight value corresponding to the zoned image data block according to a grayscale value of the zoned image data block;

adjust the zoned backlight value according to the backlight adjustment rule to obtain an adjusted zoned backlight value; and map the adjusted zoned backlight value, to a drive circuit of a backlight source of a corresponding backlight zone, so as to drive and control backlight source brightness of the corresponding backlight zone;

wherein a grayscale value distribution of the image signal represents a grayscale value distribution of pixels of the image signal, the first preset rule includes a corresponding relationship between the grayscale value distribution and the backlight adjustment rule, and the backlight adjustment rule is a corresponding relationship between the backlight value and an adjustment coefficient.

In yet another aspect, embodiments of the present application provide a liquid crystal display device, including: a memory, a processor, a backlight processor, and a pulse width modulation (PWM) driver, wherein the memory, the processor, the backlight processor, and the PWM driver are connected via a bus; and wherein:

the memory is configured to store instructions;

the processor is configured to execute the instructions stored in the memory, and the processor is also configured to receive an image signal for data processing, output processed image data to a timing controller which generates a driving signal for controlling image displaying of a liquid crystal panel according to the processed image data, and output a zoned backlight value to a backlight processor according to the processed image signal;

wherein the processor is further configured to determine a backlight adjustment rule according to a grayscale value distribution of the image signal and a first preset rule; determine a zoned image data block according to the image signal and a preset division rule, determine the zoned backlight value corresponding to the zoned image data block according to a grayscale value of the zoned image data block; and adjust the zoned backlight value according to the backlight adjustment rule to obtain an adjusted zoned backlight value; wherein a grayscale value distribution of the image signal represents a grayscale value distribution of pixels of the image signal, the first preset rule includes a corresponding relationship between the grayscale value distribution and the backlight adjustment rule, and the backlight adjustment rule is a corresponding relationship between the backlight value and an adjustment coefficient;

the backlight processor is configured to determine according to each zoned backlight value, a duty cycle and current data of a corresponding PWM signal, and output the duty cycle and the current data of the corresponding PWM signal to the PWM driver; and the PWM driver is configured to generate a PWM control signal to control a backlight source of a corresponding backlight zone.

BRIEF DESCRIPTION OF THE DRAWINGS

In order to make the technical solutions according to the embodiments of the application more apparent, the drawings to which a description of the embodiments or the prior art refers will be briefly introduced below, and apparently the drawings to be described below are merely illustrative of some of the embodiments of the application, and those ordinarily skilled in the art can derive from these drawings other drawings without any inventive effort. In the drawings.

DESCRIPTION OF EMBODIMENTS

In order to render a clearer description of the purpose, technical solutions and advantages of embodiments of the present application, the technical solutions according to the embodiments of the present application will be described below clearly and fully with reference to the drawings in the embodiments of the present application, and apparently the embodiments described below are only a part but not all of the embodiments of the present application. Based upon the embodiments here of the present application, all the other embodiments which can occur to those skilled in the art without any inventive effort shall fall into the scope of the present application.

Figure 1:
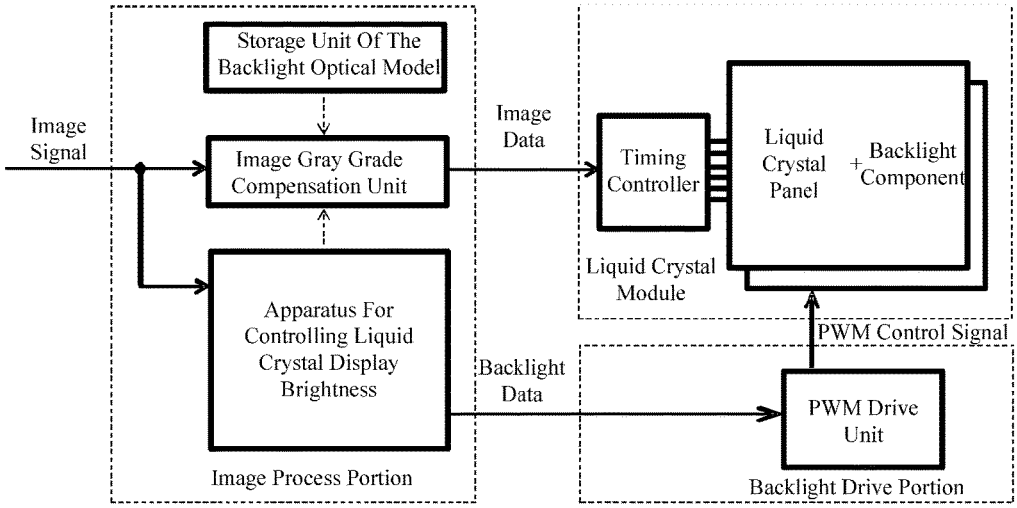
FIG. 1 illustrates a schematic diagram of part of a liquid crystal display device according to an embodiment of the present application.

FIG. 1 illustrates a schematic diagram of part of a liquid crystal display device according to an embodiment of the present application. In this application, an apparatus for controlling liquid crystal display brightness is applied to realize the adjustment of the zoned backlight values by using different backlight adjustment rules for image signals of different grayscale value distributions, thereby significantly improving the picture hierarchy of different image signals, and enhancing the displaying quality of a picture. As shown in FIG. 1, the apparatus for controlling liquid crystal display brightness may be provided in an image process portion of a liquid crystal display device, where the apparatus for controlling liquid crystal display brightness is integrated with a processing function and a storage function, or may be just provided with the processing function, while the storage function maybe achieved by using a storage unit of a backlight optical model. The apparatus for controlling liquid crystal display brightness may be a single video processing chip, or may be consisted of a plurality of collaborative video processing chips, wherein the liquid crystal display device provided with the apparatus for controlling liquid crystal display brightness may be a liquid crystal display television, a liquid crystal display, a tablet computer, or the like. The image process portion receives an input image signal which are divided into two lines of signals: one line goes through an image grayscale compensation unit, via which, the image signal are compensated by a preset image data grayscale compensation algorithm, according to a preset function relationship in the storage unit of the backlight optical model, and the compensated image data are output to a timing controller for driving a liquid crystal panel to display an image; and the other line goes through the apparatus for controlling liquid crystal display brightness according to embodiments of the present application, via which, the image signals are processed to obtain backlight data, and the backlight data are output to a backlight drive portion, to control the backlight drive portion to control brightness of a backlight source in a backlight component. The following embodiments of the present application will explain how to adjust zoned backlight values for image signals of different grayscale value distributions, by the apparatus for controlling liquid crystal display brightness, using different backlight adjustment rules, thereby significantly improving the picture hierarchy of different image signals and enhancing the displaying quality of the picture.

Figure 2:
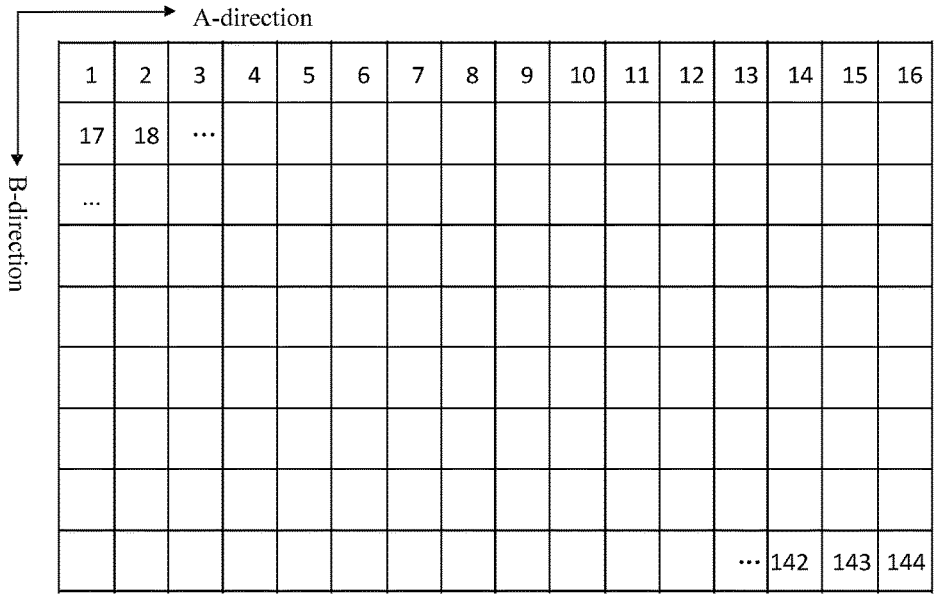
FIG. 2 illustrates a schematic diagram of a backlight zone in multi-zone dynamic backlight modulation technology.

The present application relates to the multi-zone dynamic backlight modulation technology, in which an entire backlight source matrix is divided into a plurality of backlight zones in a row-direction and a column-direction, and a backlight source included in each backlight zone may be individually driven to control its brightness, and in an ideally situation of the backlight zones, each backlight zone may independently illuminate its backlight area. FIG. 2 illustrates a schematic diagram of a backlight zone in multi-zone dynamic backlight modulation technology. As shown in FIG. 2, the entire backlight source matrix includes M zones in A-direction and N zones in B-direction. As shown in figure, assuming that M=16 and N=9, it amounts M*N=144 backlight zones, and a backlight source brightness in each backlight zone can be individually driven and controlled. In the multi-zone dynamic backlight modulation technology, a global image of each frame is divided into a plurality of zoned image data blocks corresponding to the backlight zones, and the grayscale values of all the pixels of the zoned image data blocks are collected for obtaining backlight data of the backlight zones, wherein backlight datum of each zone obtained by collecting reflects the brightness difference among their corresponding zoned image data blocks. It can be seen that, the "zoned image data blocks" involved in this application refers to that, an image data aggregation of all pixels displayed in a display zone of a liquid crystal panel, which has a same position with a backlight zone, where the division of the liquid crystal panel and the backlight zone adopts a same division rule, wherein, due to design errors and process errors, or considerations of design requirements, a boundary of a backlight zone and a boundary of a zone on the liquid crystal plane corresponding to a zoned image data block, may not completely coincide. Further, the backlight zone and the liquid crystal panel zone refer to a virtual boundary, and there are no physical boundary in an actual design.

Figure 3:
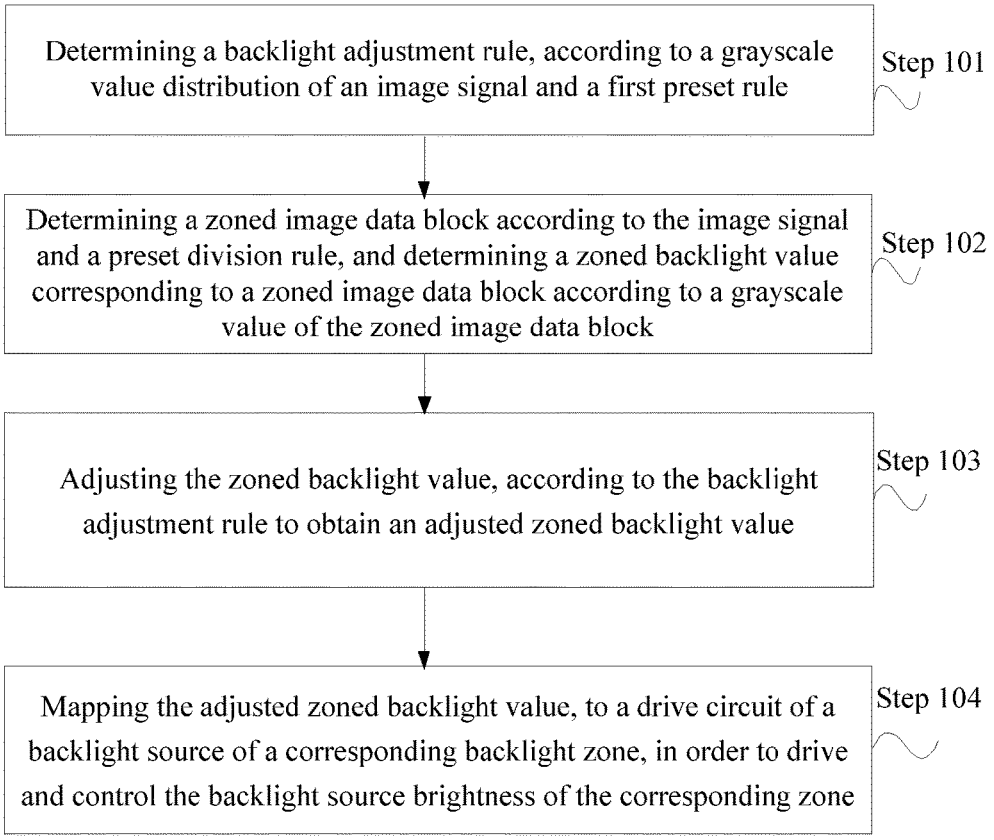
FIG. 3 illustrates a flow chart of a method for controlling liquid crystal display brightness according to an embodiment of the present application.

FIG. 3 illustrates a flow chart of a method for controlling liquid crystal display brightness according to an embodiment of the present application, as shown in FIG. 3, the method may include:

Step 101, determining a backlight adjustment rule, according to a grayscale value distribution of an image signal and a first preset rule.

Wherein, the grayscale value distribution of the image signal represents a grayscale value distribution of pixels of the image signal, the first preset rule may include a corresponding relationship between the grayscale value distribution and the backlight adjustment rule, the backlight adjustment rule is a corresponding relationship between a backlight value and an adjustment coefficient, and the adjustment coefficient is a ratio of an adjusted zoned backlight value and an zoned backlight value. The first preset rule described above may include a corresponding relationship between the grayscale value distribution and a plurality of backlight adjustment rules, and the adjustment coefficient described above may be any value greater than 1 or any value less than or equal to 1.

Optionally, a determining manner of the grayscale value distribution in step 101 may be: generating a grayscale histogram according to the grayscale value of the pixels of the image signal, and determining the grayscale value distribution of the image signal according to the grayscale histogram.

Step 102, determining a zoned image data block according to the image signal and a preset division rule, and determining a zoned backlight value corresponding to a zoned image data block according to a grayscale value of the zoned image data block.

The preset division rule refers to the schematic diagram of the backlight zones as shown in FIG. 2, i.e., the preset division rule, wherein M and N also maybe selected as other positive integers, which will not be illustrated one by one herein. Due to different preset division rules, the sizes and positions of the backlight zones are different. Therefore, the zoned image data blocks corresponding to the backlight zones are not the same, so it is necessary to determine the zoned image data blocks in conjunction with the preset division rule. After obtaining each zoned image data block, the zoned backlight value corresponding to the zoned image data block can be determined according to the grayscale value of each zoned image data block, wherein there are variety of choices of methods for calculating the zoned backlight value, such as the maximum value method, the average value method, the weighted mean method, the average weighting method, and etc. other backlight value calculation methods maybe obtained by persons skilled in the art without creative effort, and the present application may also obtain the zoned backlight values via other methods, which will not be limited herein. Taking the average value method as an example, the grayscale values of all pixels of a zoned image data block are collected, and the collected grayscale values of all pixels are summed and averaged, to obtain the zoned backlight value corresponding to the zoned image data block, and the zoned backlight values corresponding to other image data blocks maybe obtained in accordance with the same method.

Step 103, adjusting the zoned backlight value, according to the backlight adjustment rule to obtain an adjusted zoned backlight value.

The zoned backlight value, corresponding to the respective zoned image data block obtained in step 102, needs to be processed in step 103 for obtaining the adjusted zoned backlight value, which maybe finally used to drive the drive circuit of the backlight source of the corresponding backlight zone.

Step 104, mapping the adjusted zoned backlight value, to a drive circuit of a backlight source of a corresponding backlight zone, so as to drive and control the backlight source brightness of the corresponding backlight zone.

The implementation of step 104 may be: respectively converting, the adjusted zoned backlight value corresponding to the respective zoned image data block, to a duty cycle and current data which are input into a PWM driver as backlight data, so as to drive and control the backlight source brightness of the corresponding backlight zone of each zoned image data block.

The present application determines the backlight adjustment rule according to the grayscale value distribution of the image signal and the first preset rule, adjusts the zoned backlight value corresponding to the zoned image data block according to the backlight adjustment rule, and drives and controls the backlight source brightness of the corresponding backlight zone by using the adjusted zoned backlight value, thereby adjusting the zoned backlight values for the image signals of different grayscale value distributions by using different backlight adjustment rules, significantly improving the picture hierarchy of different image signals, and enhancing the displaying quality of the picture.

The technical solution of the embodiment of the method shown in FIG. 3 will be described below in detail.

Figure 4:
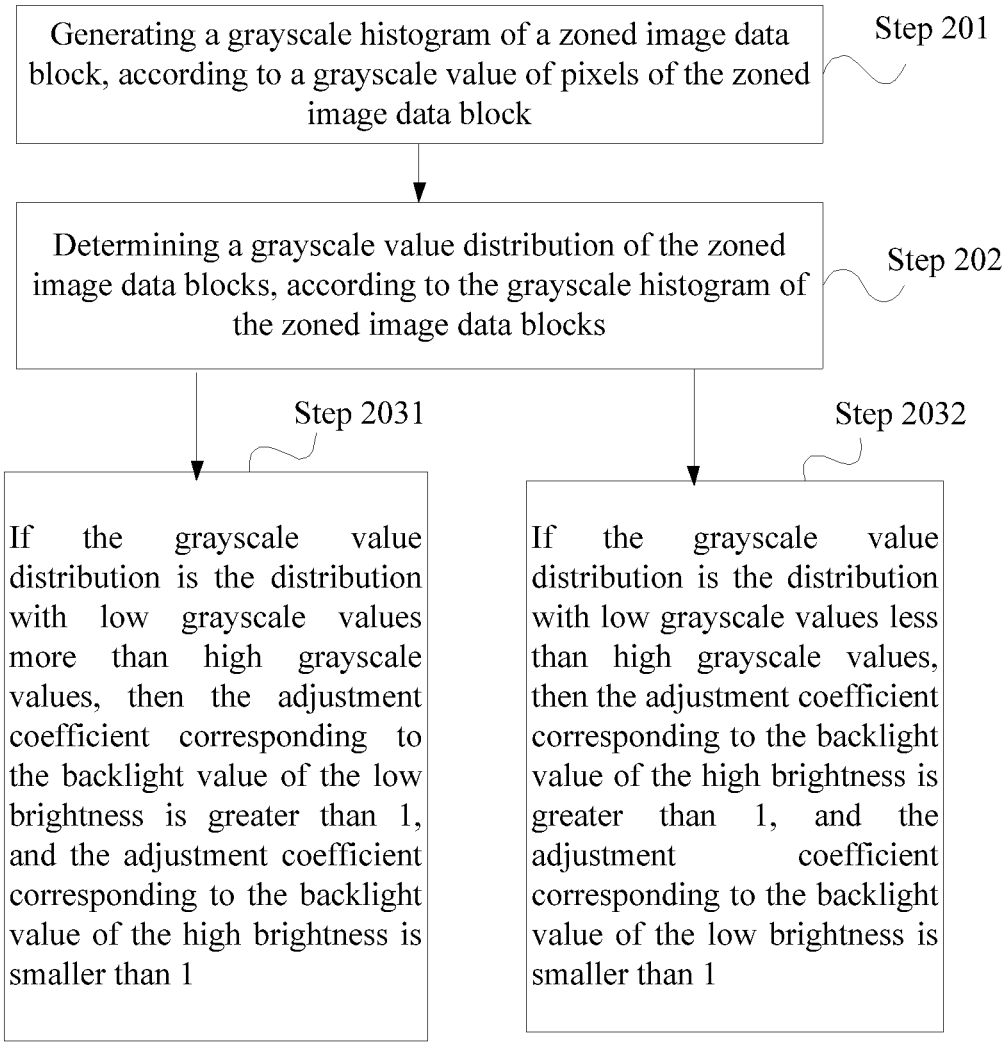
FIG. 4 illustrates a flow chart of a method for controlling liquid crystal display brightness according to another embodiment of the present application.
Figure 5A:
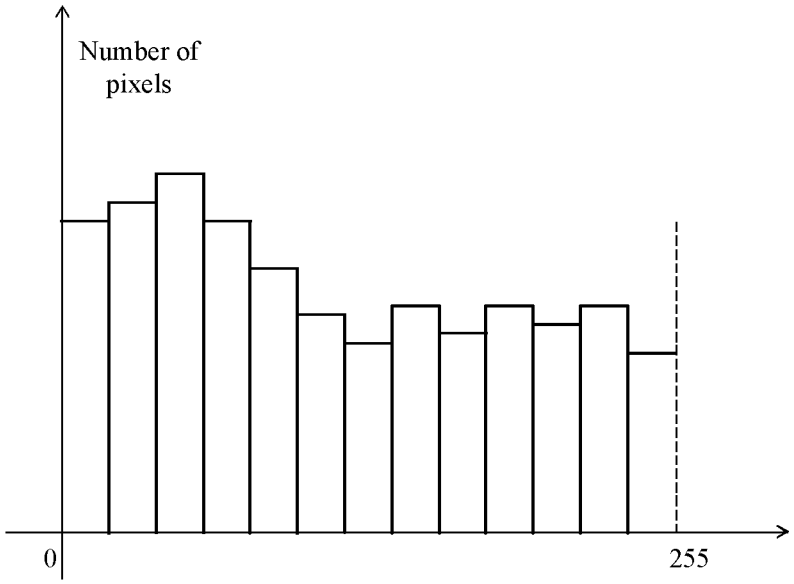
FIG. 5A illustrates a schematic diagram of an example of a grayscale histogram.
Figure 5B:
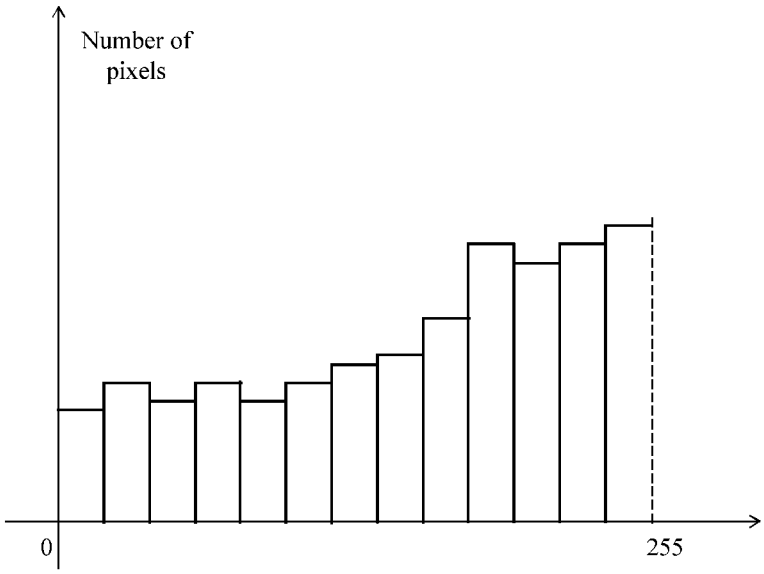
FIG. 5B illustrates a schematic diagram of another example of the grayscale histogram.
Figure 5C:
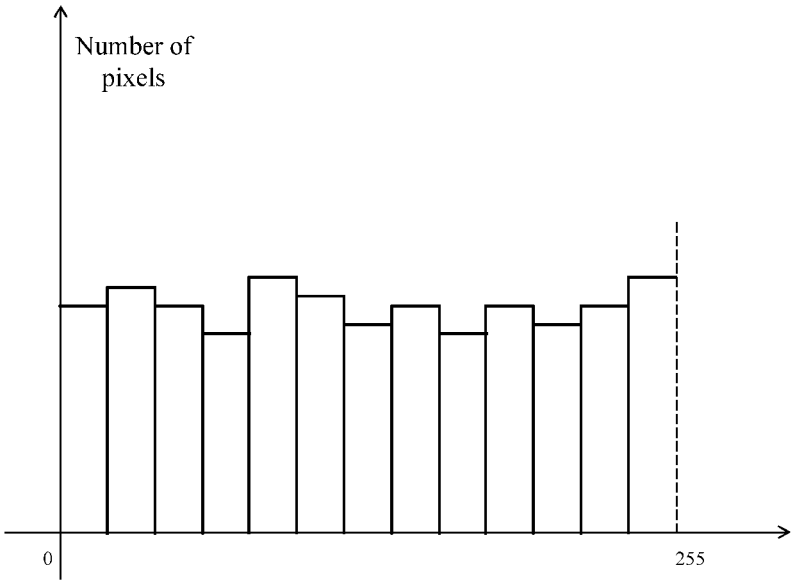
FIG. 5C illustrates a schematic diagram of yet another example of the grayscale histogram.

FIG. 4 illustrates a flow chart of a method for controlling liquid crystal display brightness according to another embodiment of the present application, FIG. 5A illustrates a schematic diagram of an example of a grayscale histogram, FIG. 5B illustrates a schematic diagram of another example of the grayscale histogram, and FIG. 5C illustrates a schematic diagram of yet another example of the grayscale histogram. This embodiment of the present application is an implementation method of step 101 of the embodiment shown in FIG. 3, and as shown in FIG. 4, the method may include:

Step 201, generating a grayscale histogram of a zoned image data block, according to a grayscale value of pixels of the zoned image data block.

Histogram, as a direct representation, can directly represent the grayscale value distribution of the image signal. Three grayscale histograms shown in FIGS. 5A to 5C are taken as examples. As shown in FIG. 5A to FIG. 5C, the horizontal axes thereof represent different grayscale values (0 to 255, with a width of 8 bits ($2^8$=256 grayscale) as an example, while the present application is also applicable to other grayscale values, which is not limited herein); the vertical axes thereof represent the number of pixels, and each rectangle column represents a number of pixels of a grayscale value, wherein a rectangle column may also represent a number of pixels within a range of grayscale values, which can be flexibly set as desired.

Step 202, determining a grayscale value distribution of the zoned image data blocks, according to the grayscale histogram of the zoned image data blocks.

Wherein, the grayscale value distribution may include a distribution with more low grayscale values than high grayscale values, a distribution with less low grayscale values than high grayscale values, and an average distribution. FIG. 5A to FIG. 5B are further taken as examples, where the grayscale value distribution corresponding to FIG. 5A is a distribution with more low grayscale values than high grayscale values, and the grayscale value distribution corresponding to FIG. 5B is a distribution with less low grayscale values than high grayscale values.

The present application determines the grayscale value distribution of an image signal by using a grayscale histogram, and those skilled in the art may determine the grayscale value distribution of the image signal in other manners.

Step 2031, if the grayscale value distribution is the distribution with more low grayscale values than high grayscale values, then the adjustment coefficient corresponding to the backlight value of the low brightness is greater than 1, and the adjustment coefficient corresponding to the backlight value of the high brightness is smaller than 1.

The backlight adjustment rule corresponding to the distribution with more low grayscale values than high grayscale values is that the adjustment coefficient corresponding to the backlight value of the low brightness is greater than 1, and the adjustment coefficient corresponding to the backlight value of the high brightness is smaller than 1.

Step 2032, if the grayscale value distribution is the distribution with less low grayscale values than high grayscale values, then the adjustment coefficient corresponding to the backlight value of the high brightness is greater than 1, and the adjustment coefficient corresponding to the backlight value of the low brightness is smaller than 1.

The backlight adjustment rule corresponding to the distribution with less low grayscale values than high grayscale values is that, the adjustment coefficient corresponding to the backlight value of the high brightness is greater than 1, and the adjustment coefficient corresponding to the backlight value of the low brightness is smaller than 1.

The first preset rule may include a corresponding relationship between the above-mentioned two kinds of grayscale value distributions and the two kinds of backlight adjustment rules.

Optionally, the grayscale value distribution may also be an average distribution, and the grayscale value distribution corresponding to FIG. 5C is the average distribution. If the grayscale value distribution is the average distribution, then all adjustment coefficients corresponding to each backlight value are 1. Accordingly, the first preset rule may include a corresponding relationship between three kinds of grayscale value distributions and three kinds of adjustment rules.

It can be seen that, when the grayscale value distribution of the zoned image data blocks is a distribution with more low grayscale values than high grayscale values, that is to say, the low brightness area in the zoned image data block is large, in such case, the zoned backlight values of low brightness are increased and the zoned backlight values of high brightness are decreased via the backlight adjustment rules corresponding to the grayscale value distribution of the present application, thereby better displaying the picture details of the low brightness area in the zoned image data block and enhancing the overall hierarchy of the displayed image.

When the grayscale value distribution of the zoned image data blocks is a distribution with less low grayscale values than high grayscale values, that is to say, the high brightness area in the zoned image data block is large, in such case, the zoned backlight values of high brightness are increased and the zoned backlight values of low brightness are decreased via the backlight adjustment rules corresponding to the grayscale value distribution of the present application, thereby better displaying the picture details of the high brightness area in the zoned image data block and enhancing the overall hierarchy of the displayed image.

An alternative implementation may be that, the above-mentioned backlight adjustment rule, corresponding to the distribution with more low grayscale values than high grayscale values, may be a reversed S-shape backlight adjustment curve; the above-mentioned backlight adjustment rule, corresponding to the distribution with less low grayscale values than high grayscale values, may be a forward S-shape backlight adjustment curve; and the above-mentioned backlight adjustment rule, corresponding to the average distribution, may be a backlight adjustment straight line. The horizontal axes of the reversed S-shape backlight adjustment curve, the forward S-shape backlight adjustment curve and the backlight adjustment straight line are backlight values, and the vertical axes thereof are adjusted zoned backlight values. During the determining of the adjusted zoned backlight value, the zoned backlight value corresponding to the zoned image data block can be matched to the backlight value of the horizontal axis for obtaining the adjusted zoned backlight value.

Figure 6A:
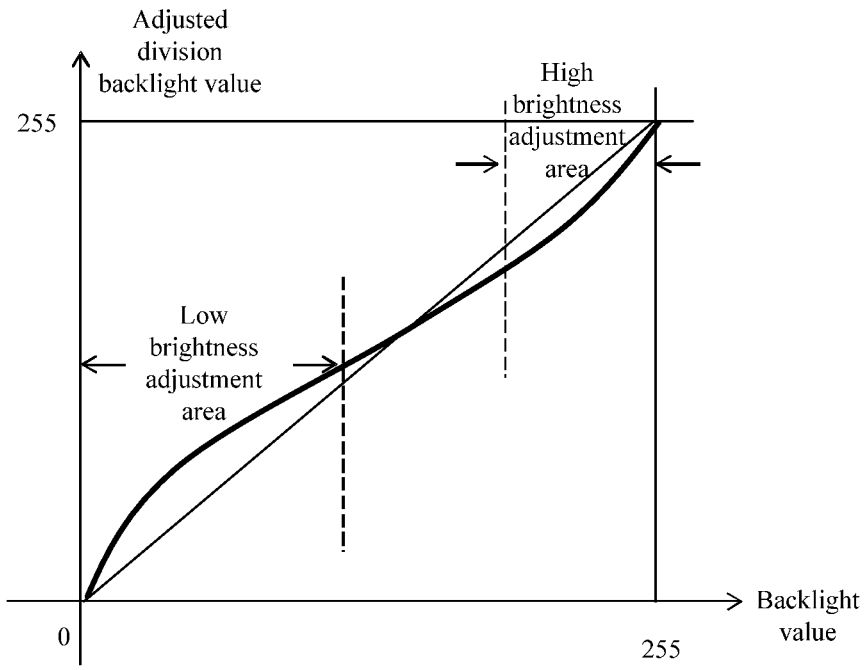
FIG. 6A illustrates a schematic diagram of an example of a reversed S-shape backlight adjustment curve.
Figure 6B:
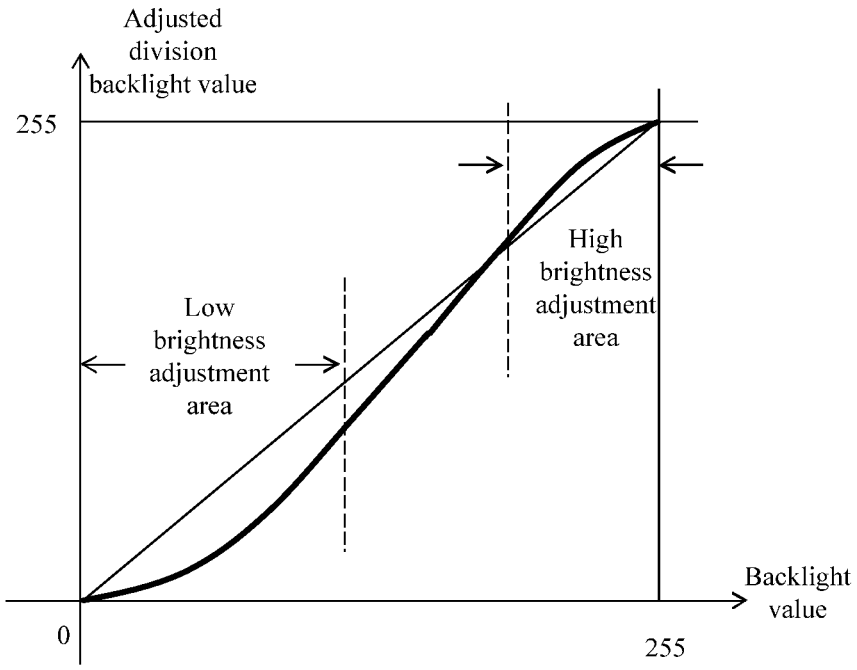
FIG. 6B illustrates a schematic diagram of an example of a forward S-shape backlight adjustment curve.

A reversed S-shape backlight adjustment curve and a forward S-shape backlight adjustment curve are employed as illustrative examples. FIG. 6A illustrates a schematic diagram of an example of the reversed S-shape backlight adjustment curve and FIG. 6B illustrates a schematic diagram of an example of the forward S-shape backlight adjustment curve. As shown in FIG. 6A, the horizontal axis represents backlight value and the vertical axis represents adjusted zoned backlight value, wherein the illustrated curve is the reversed S-shape backlight adjustment curve and the illustrated straight line is the backlight adjustment straight line. The slopes of the curve and the straight line are adjustment coefficients, while the slope of curve in the low brightness adjustment area is smaller than 1, the slope of curve in the high brightness adjustment area is greater than 1, and the slope of backlight adjustment straight line is 1.

The reversed S-shape backlight adjustment curve and the forward S-shape backlight adjustment curve illustrated respectively in FIG. 6A and FIG. 6B are both smooth curves, and in some implementations, these curves may be nonsmooth such as broken lines or the like. Moreover, the implementation illustrated in FIG. 6A and FIG. 6B are only one kind of realizable implementation of the reversed S-shape backlight adjustment curve and the forward S-shape backlight adjustment curve, which may also be set as tables recording the adjusted zoned backlight values corresponding to different backlight values.

In the present application, the grayscale value distributions of the image signals are classified into three kinds, and also the backlight adjustment rules are set into three kinds. In some implementations, a more detailed classification can be performed on the grayscale value distribution and the backlight adjustment rule, while the present application does not intend to limit to the above three.

In the related art, so as to enhance the display effect of the liquid crystal display, various methods are generally employed to enhance the brightness contrast of a picture, i.e., a higher backlight brightness is applied to the bright part in one frame of the image displayed on the liquid crystal display, and a lower backlight brightness is applied to the dark scene part of the image, thereby enhancing the brightness contrast of the picture. However, the picture hierarchy performance is usually insufficient in the low brightness picture display, resulting in an affected displaying effect.

The present application, by generating the grayscale histogram of the zoned image data blocks, and on the basis of this, determining the grayscale value distribution of the image signals, if the grayscale value distribution of the zoned image data blocks is the distribution with more low grayscale values than high grayscale values, then employing the reversed S-shape backlight adjustment curve to adjust the zoned backlight values for obtaining the adjusted zoned backlight values, displays the picture details in the low brightness area better; and by that if the grayscale value distribution of the zoned image data blocks is the distribution with less low grayscale values than high grayscale values, then employing the forward S-shape backlight adjustment curve to adjust the zoned backlight values for obtaining the adjusted zoned backlight values, displays the picture details in the high brightness area better, thereby adjusting the zoned backlight values for the image signals of different grayscale value distributions by using different backlight adjustment rules, significantly improving the picture hierarchy of different image signals, and enhancing the displaying quality of the picture.

Figure 7:
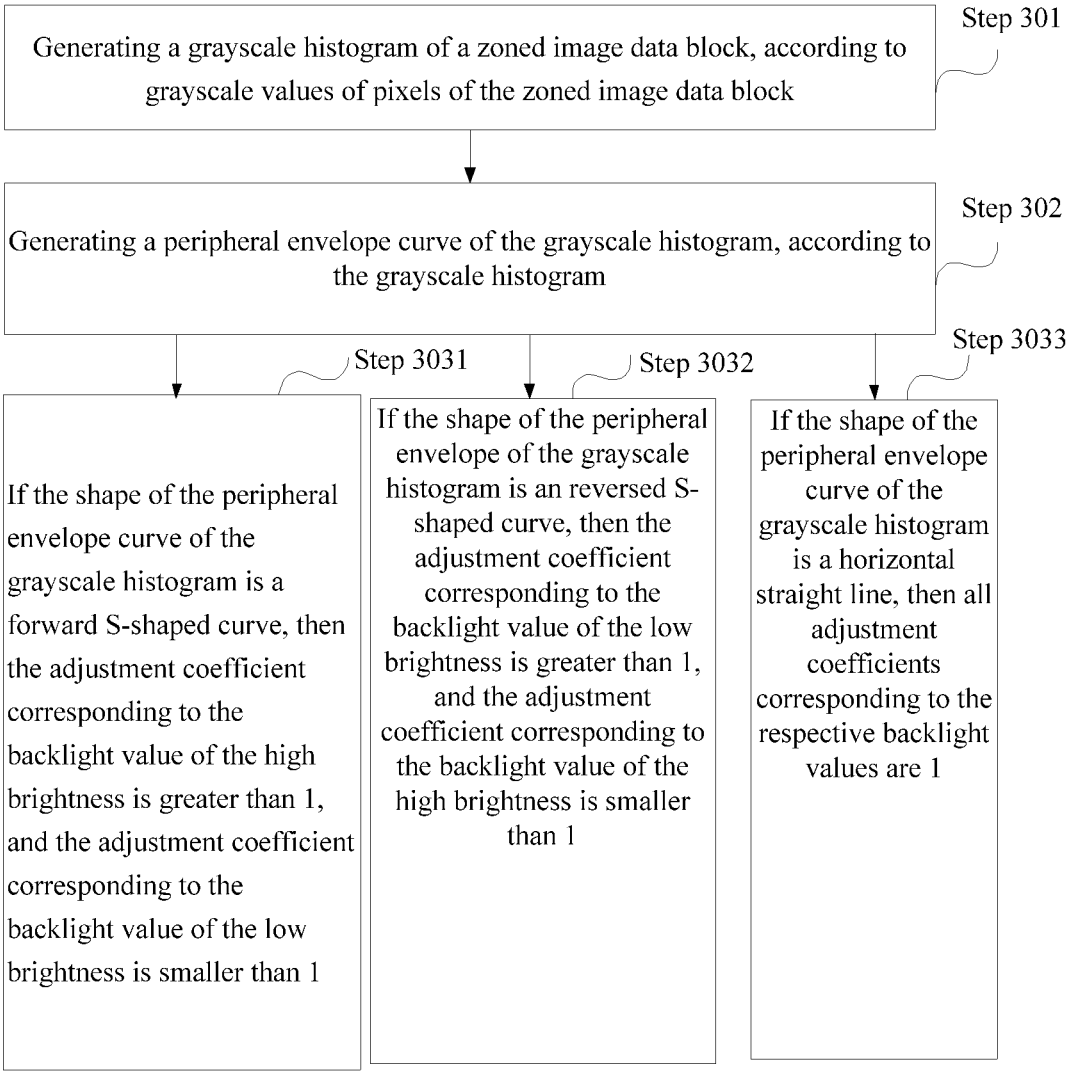
FIG. 7 illustrates a flow chart of a method for controlling liquid crystal display brightness according to yet another embodiment of the present application.
Figure 8A:
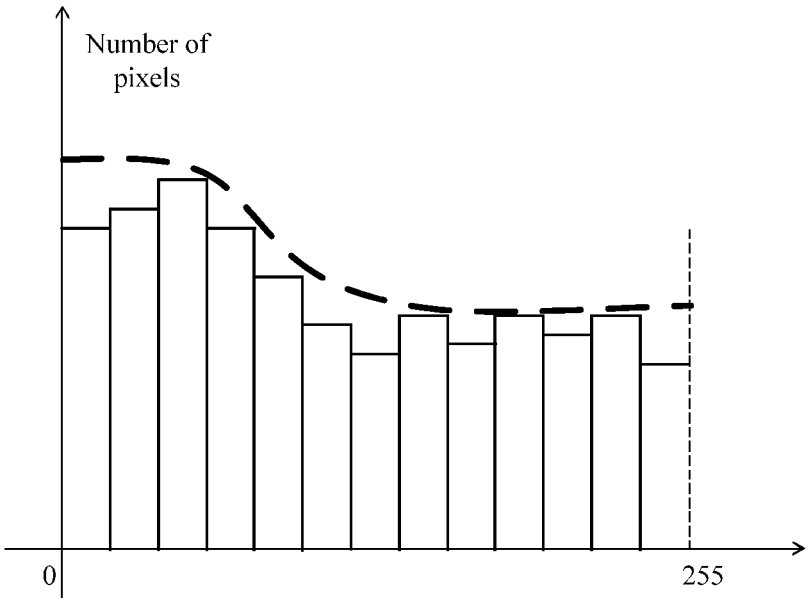
FIG. 8A illustrates a schematic diagram of an example of a peripheral envelope curve of a grayscale histogram.
Figure 8B:
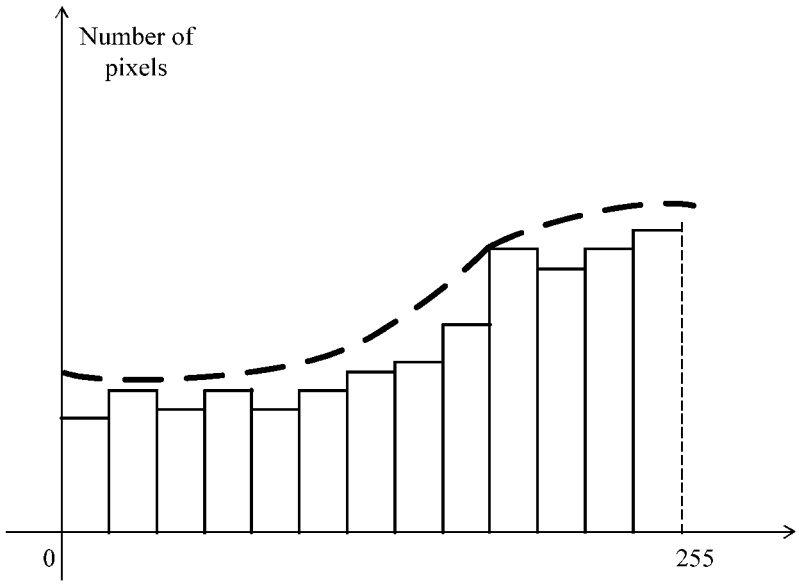
FIG. 8B illustrates a schematic diagram of another example of the peripheral envelope curve of the grayscale histogram.
Figure 8C:
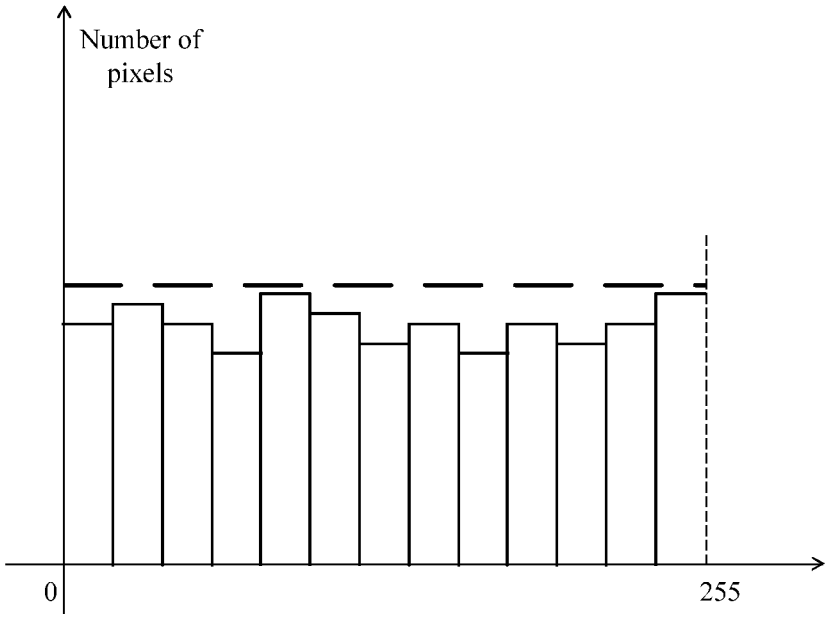
FIG. 8C illustrates a schematic diagram of yet another example of the peripheral envelope curve of the grayscale histogram.

FIG. 7 illustrates a flow chart of a method for controlling liquid crystal display brightness according to yet another embodiment of the present application, FIG. 8A illustrates a schematic diagram of an example of a peripheral envelope curve of a grayscale histogram, FIG. 8B illustrates a schematic diagram of another example of the peripheral envelope curve of the grayscale histogram, and FIG. 8C illustrates a schematic diagram of yet another example of the peripheral envelope curve of the grayscale histogram. This embodiment of the present application is another implementation method of step 101 of the embodiment shown in FIG. 3, and as shown in FIG. 7, the method may include:

Step 301, generating a grayscale histogram of a zoned image data block, according to grayscale values of pixels of the zoned image data block.

Step 302, generating a peripheral envelope curve of the grayscale histogram, according to the grayscale histogram.

Wherein, the peripheral envelope curve of the grayscale histogram may include a forward S-shaped curve, a reversed S-shaped curve and a horizontal straight line. FIG. 8A to FIG. 8C are further taken as examples. The peripheral envelope curve of the grayscale histogram in FIG. 8A is the reversed S-shaped curve, the peripheral envelope curve of the grayscale histogram in FIG. 8B is the forward S-shaped curve, and the peripheral envelope curve of the grayscale histogram is the horizontal straight line.

Step 3031, if the shape of the peripheral envelope curve of the grayscale histogram is a forward S-shaped curve, then the adjustment coefficient corresponding to the backlight value of the high brightness is greater than 1, and the adjustment coefficient corresponding to the backlight value of the low brightness is smaller than 1.

Wherein, the backlight adjustment rule is that, the adjustment coefficient corresponding to the backlight value of the high brightness is greater than 1, and the adjustment coefficient corresponding to the backlight value of the low brightness is smaller than 1, as shown by the curve in FIG. 6B.

Step 3032, if the shape of the peripheral envelope of the grayscale histogram is an reversed S-shaped curve, then the adjustment coefficient corresponding to the backlight value of the low brightness is greater than 1, and the adjustment coefficient corresponding to the backlight value of the high brightness is smaller than 1.

Wherein, the backlight adjustment rule is that, the adjustment coefficient corresponding to the backlight value of the low brightness is greater than 1, and the adjustment coefficient corresponding to the backlight value of the high brightness is smaller than 1, as shown by curves in FIG. 6A.

Step 3033, if the shape of the peripheral envelope curve of the grayscale histogram is a horizontal straight line, then all adjustment coefficients corresponding to the respective backlight values are 1.

Wherein, the backlight adjustment rule is that, all adjustment coefficients corresponding to the respective backlight values are 1, as shown by the backlight adjustment straight lines in FIG. 6A and FIG. 6B.

The first preset rule may include backlight adjustment rules corresponding to the peripheral envelope curves of the three kinds of grayscale histograms, i.e., the backlight adjustment rule, corresponding to the peripheral envelope curve which is a forwarded S-shaped curve, is that the adjustment coefficient corresponding to the backlight value of the high brightness is greater than 1, and the adjustment coefficient corresponding to the backlight value of the low brightness is smaller than 1; the backlight adjustment rule, corresponding to the peripheral envelope which is a reversed S-shaped curve, is that the adjustment coefficient corresponding to the backlight value of the low brightness is greater than 1, and the adjustment coefficient corresponding to the backlight value of the high brightness is smaller than 1; and the backlight adjustment rule, corresponding to the peripheral envelope curve which is a horizontal straight line, is that all adjustment coefficients corresponding to the respective backlight values are 1.

It can be seen that, when the peripheral envelope curve of the grayscale histograms of the zoned image data blocks is forwarded S-shaped curve, that is to say, the high brightness area in the zoned image data block is large, in such case, the low zoned backlight values are increased and the high zoned backlight values are decreased via the corresponding backlight adjustment rules in the present application, thereby better displaying the picture details in the low brightness area and enhancing the overall hierarchy of the displayed image.

When the peripheral envelope curve of the grayscale histograms of the zoned image data blocks is reversed S-shaped curve, that is to say, the low brightness area in the zoned image data block is large, in such case, the high zoned backlight values are increased and the low zoned backlight values are decreased via the corresponding backlight adjustment rules in the present application, thereby better displaying the picture details in the high brightness area and enhancing the overall hierarchy of the displayed image.

In some implementations, in the present application, the peripheral envelope curves of the grayscale histograms are classified into three kinds, and the backlight adjustment rules are also set into three kinds. Further, a more detailed classification can be performed on the peripheral envelope curves of the grayscale histograms and the backlight adjustment rules, while the present application does not intend to limit to the above three.

The present application, by generating the grayscale histogram of the zoned image data blocks, and on the basis of this, generating the peripheral envelope curves of the grayscale histograms, and if the peripheral envelope of the grayscale histogram is the positive S-shaped curve, then adjusting the zoned backlight value to obtain the adjusted zoned backlight values by using that the adjustment coefficient corresponding to the backlight value of the high brightness is greater than 1, and the adjustment coefficient corresponding to the backlight value of the low brightness is smaller than 1; if the peripheral envelope of the grayscale histogram is the inverse S-shaped curve, then adjusting the zoned backlight value to obtain the adjusted zoned backlight values by using that the adjustment coefficient corresponding to the backlight value of the low brightness is greater than 1, and the adjustment coefficient corresponding to the backlight value of the high brightness is smaller than 1, achieve to adjust the zoned backlight values for the image signals of different grayscale value distributions by using different backlight adjustment rules, thereby significantly improving the picture hierarchy of different image signals, and enhancing the displaying quality of the picture.

Figure 9:
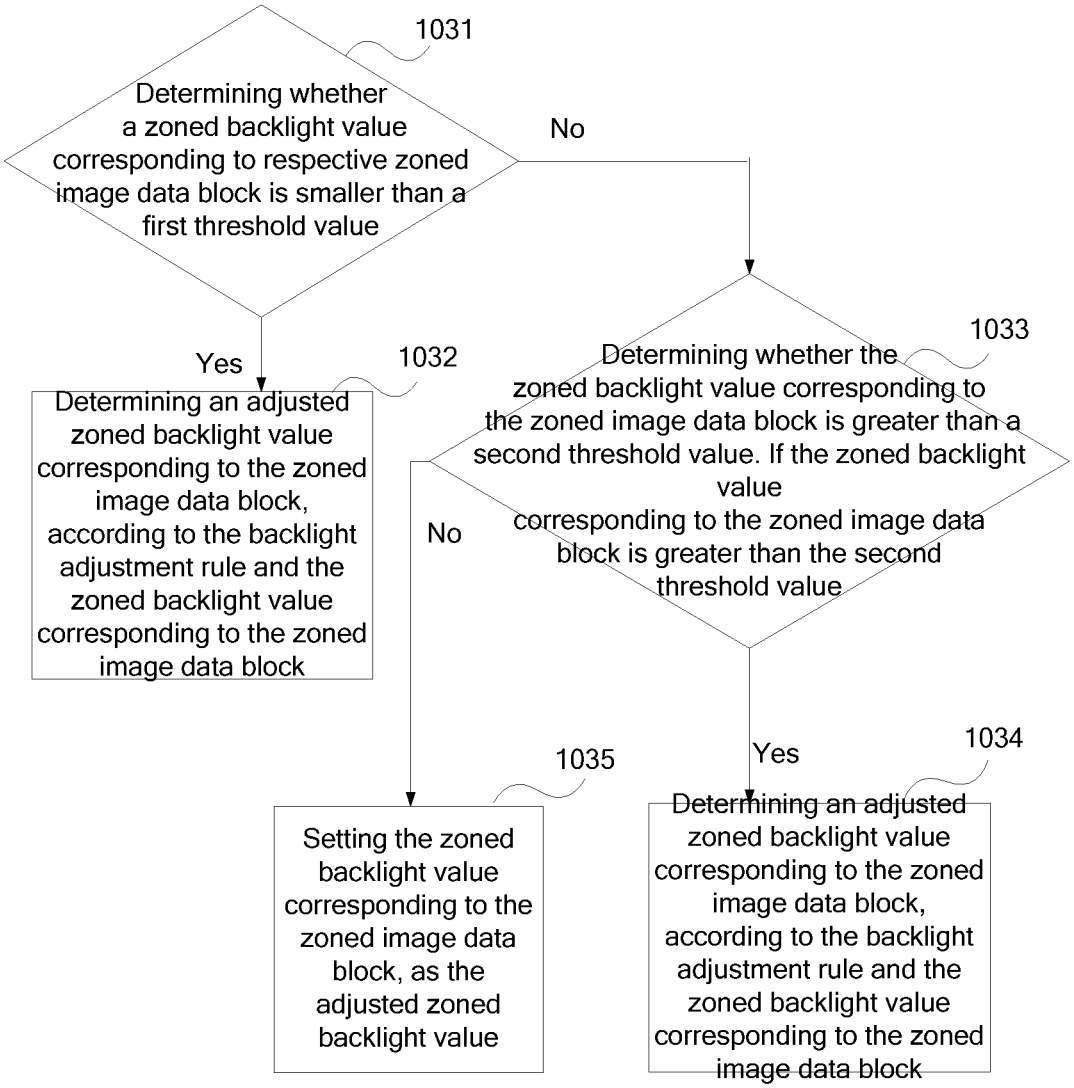
FIG. 9 illustrates a flow chart of a method for controlling liquid crystal display brightness according to yet another embodiment of the present application.

FIG. 9 illustrates a flow chart of a method for controlling the liquid crystal display brightness according to yet another embodiment of the present application. This embodiment of the present application is an implementation method of step 103 of the embodiment shown in FIG. 3, the method may include:

Step 1031, determining whether a zoned backlight value corresponding to respective zoned image data block is smaller than a first threshold value. If the zoned backlight value corresponding to respective zoned image data block is smaller than the first threshold value, step 1032 is performed; or, step 1033 is performed.

Step 1032, determining an adjusted zoned backlight value corresponding to the zoned image data block, according to the backlight adjustment rule and the zoned backlight value corresponding to the zoned image data block.

Step 1033, determining whether the zoned backlight value corresponding to the zoned image data block is greater than a second threshold value. If the zoned backlight value corresponding to the zoned image data block is greater than the second threshold value, step 1034 is performed; or, step 1035 is performed.

Step 1034, determining an adjusted zoned backlight value corresponding to the zoned image data block, according to the backlight adjustment rule and the zoned backlight value corresponding to the zoned image data block.

Step 1035, setting the zoned backlight value corresponding to the zoned image data block, as the adjusted zoned backlight value.

Further explanations will be made in conjunction with FIGS. 6A and 6B, as shown in FIG. 6A and FIG. 6B, a low brightness adjustment area and a high brightness adjustment area are provided, wherein the low brightness adjustment area refers to 0 to the first threshold value, and the high brightness adjustment area refers to the second threshold value to 255. In conjunction with the explanations of the above embodiments, it can be seen that, for the zoned backlight values between the first threshold value and the second threshold value, it may not perform the adjustment of the zoned backlight value. Such a setting can significantly improve the processing efficiency of the apparatus for controlling liquid crystal display brightness, without affecting the displaying effect of the picture. In some implementations, a third threshold value and a fourth threshold value may be set, wherein the third threshold value is set to the left side of the first threshold value, and the fourth threshold value is set to the right side of the second threshold value.

The present application achieves to adjust the zoned backlight value within the low brightness adjustment area and the zoned backlight value within the high brightness adjustment area, via setting the first threshold value and the second threshold value, thereby improving the picture hierarchy of different image signals, enhancing the displaying quality of the picture, and significantly improving the processing efficiency of the apparatus for controlling liquid crystal display brightness.

The executing order of the steps in the method embodiments described above is not limited by the present application.

Figure 10:
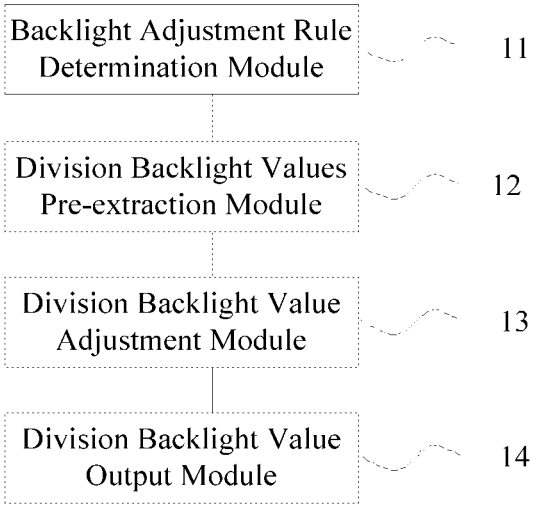
FIG. 10 illustrates a schematic diagram of an apparatus for controlling liquid crystal display brightness according to an embodiment of the present application.

FIG. 10 illustrates a schematic diagram of an apparatus for controlling liquid crystal display brightness according to an embodiment of the present application. As shown in FIG. 10, this apparatus may include a backlight adjustment rule determination module 11, a zoned backlight values pre-extraction module 12, a zoned backlight value adjustment module 13 and a zoned backlight value output module 14, wherein the backlight adjustment rule determination module 11 is configured to determine a backlight adjustment rule according to a grayscale value distribution of an image signal and a first preset rule; the zoned backlight value pre-extraction module 12 is configured to determine a zoned image data block according to the image signal and a preset division rule, and determine a zoned backlight value corresponding to a zoned image data block according to a grayscale value of the zoned image data block; the zoned backlight value adjustment module 13 is configured to adjust the zoned backlight value to obtain an adjusted zoned backlight value according to the backlight adjustment rule; and the zoned backlight value output module 14 is configured to map the adjusted zoned backlight value to a drive circuit of a backlight source of a corresponding backlight zone, so as to drive and control the backlight source brightness of the corresponding backlight zone. Wherein, the grayscale value distribution of the image signal represents a grayscale value distribution of pixels of the image signal; the first preset rule includes a corresponding relationship between the grayscale value distribution and the backlight adjustment rule; and the backlight adjustment rules refers to a corresponding relationship between the a backlight value and an adjustment coefficient.

The apparatus may be used to carry out the technical solutions of the method embodiments as described above, the realization principle and the technical effect of which are similar and will not be repeated herein.

Figure 11:
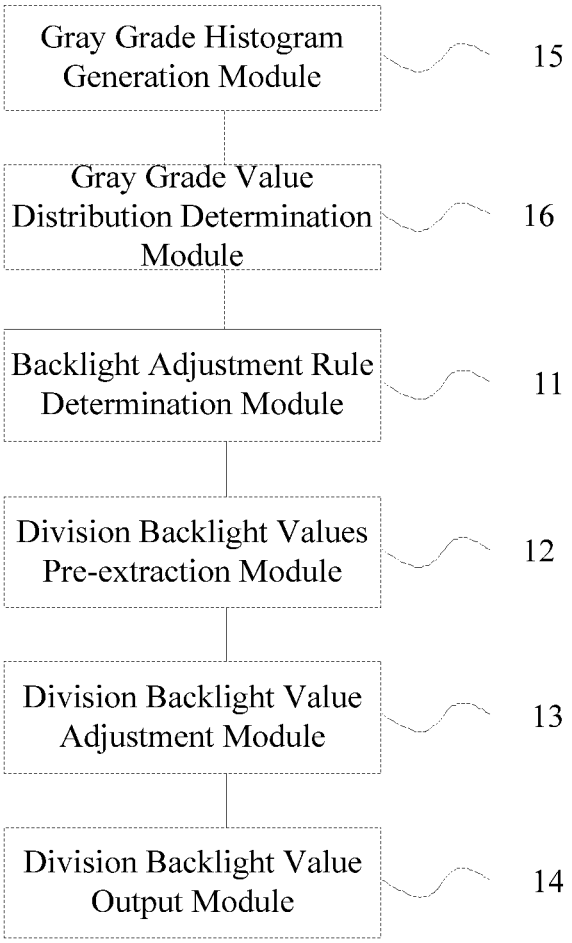
FIG. 11 illustrates a schematic diagram of an apparatus for controlling liquid crystal display brightness according to another embodiment of the present application.

FIG. 11 illustrates a schematic diagram of an apparatus for controlling liquid crystal display brightness according to another embodiment of the present application. As shown in FIG. 11, on the basis of the apparatus structure as shown in FIG. 10, the apparatus may further include a grayscale histogram generation module 15 and a grayscale value distribution determination module 16, wherein the grayscale histogram generation module 15 is configured to generate a grayscale histogram according to grayscale values of pixels of the image signal, and the grayscale value distribution determination module 16 is configured to determine the grayscale value distribution of the image signal according to the grayscale histogram.

Optionally, the grayscale histogram generation module 15 is configured to generate a grayscale histogram of respective zoned image data block according to the grayscale values of the pixels of the zoned image data block; the grayscale value distribution determination module 16 is configured to determine the grayscale value distribution of the zoned image data blocks according to the grayscale histogram of the zoned image data blocks.

Optionally, the backlight adjustment rule determination module 11 is configured to determine a backlight adjustment rule according to a grayscale value distribution of the zoned image data blocks and a first preset rule, including: if the grayscale value distribution of the zoned image data blocks is a distribution with more low grayscale values than high grayscale values, then the adjustment coefficient corresponding to the backlight value of the low brightness is greater than 1, and the adjustment coefficient corresponding to the backlight value of the high brightness is smaller than 1; if the grayscale value distribution of the zoned image data blocks is a distribution with less low grayscale values than high grayscale values, then the adjustment coefficient corresponding to the backlight value of the high brightness is greater than 1, and the adjustment coefficient corresponding to the backlight value of the low brightness is smaller than 1.

Optionally, the backlight adjustment rule determination module 11 is configured to determine the backlight adjustment rule according to the grayscale value distribution of the image signal and the first preset rule, including: generating, a peripheral envelope curve of the grayscale histogram, according to the grayscale histogram; and determining, the backlight adjustment rule, according to the peripheral envelope curve and the first preset rule.

Optionally, the backlight adjustment rule determination module 11 is configured to determine the backlight adjustment rule according to the peripheral envelope curve and a first preset rule, including: if the peripheral envelope is a forwarded S-shaped curve, then the adjustment coefficient corresponding to the backlight value of the high brightness is greater than 1, and the adjustment coefficient corresponding to the backlight value of the low brightness is smaller than 1; if the peripheral envelope is an reversed S-shaped curve, then the adjustment coefficient corresponding to the backlight value of the low brightness is greater than 1, and the adjustment coefficient corresponding to the backlight value of the high brightness is smaller than 1; if the peripheral envelope curve is a horizontal straight line, then all adjustment coefficients corresponding to respective backlight value are 1.

The embodiment of the present application also provides an apparatus for controlling liquid crystal display brightness, including: a memory for storing instructions; a processor coupled with the memory, the processor is configured to execute the instructions stored in the memory, and the processor is also configured to: determine a backlight adjustment rule according to the grayscale value distribution of the image signal and the first preset rule; determine a zoned image data block according to the image signal and a preset division rule, and determine a zoned backlight value corresponding to the zoned image data block according to a grayscale value of the zoned image data block; adjust the zoned backlight value to obtain an adjusted zoned backlight value according to the backlight adjustment rule; and map the adjusted zoned backlight value to a drive circuit of a backlight source of a corresponding backlight zone so as to drive and control the backlight source brightness of the corresponding backlight zone; wherein, a grayscale value distribution of the image signal represents the grayscale value distribution of pixels of the image signal, the first preset rule includes a corresponding relationship between the grayscale value distribution and the backlight adjustment rule, and the backlight adjustment rule is a corresponding relationship between the backlight value and an adjustment coefficient.

The processor in the apparatus for controlling the liquid crystal display brightness provided herein may also be configured to perform any of the methods for controlling liquid crystal display brightness provided in the foregoing embodiments of the present application, the realization principle and the technical effect of which are similar and will not be repeated herein.

Figure 12:
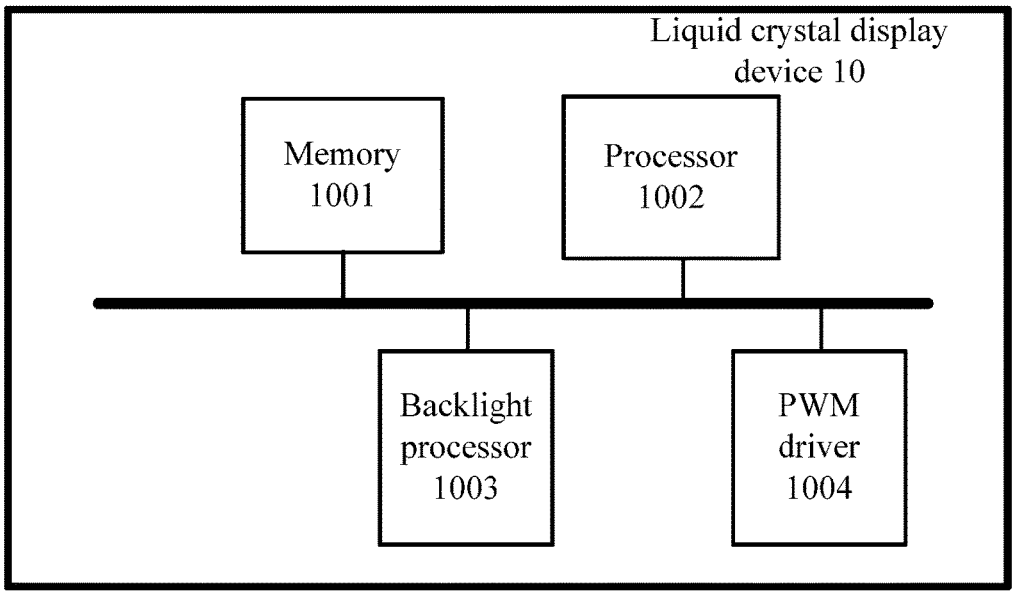
FIG. 12 illustrates a schematic diagram of a liquid crystal display device according to an embodiment of the present application.

FIG. 12 illustrates a schematic diagram of a liquid crystal display device according to an embodiment of the present application. The present embodiment only shows a part related to the method for controlling liquid crystal display brightness of the present application. It should be understood that the liquid crystal display device may include other parts, such as a liquid crystal panel, a backlight component, and the like. As shown in FIG. 12, the liquid crystal display device 10 may include: a memory 1001, a processor 1002, a backlight processor 1003, and a PWM driver 1004. The memory 1001, the processor 1002, the backlight processor 1003, and the PWM driver 1004 are connected via a bus (shown as a thick line illustrated in the figure). The memory 1001 is configured to store instructions; the processor 1002 is configured to execute the instructions stored in the memory, and the processor is also configured to receive an image signal for data processing, output processed image data to a timing controller which generates a drive signal for controlling image displaying of a liquid crystal panel according to the processed image data, and output a zoned backlight value to a backlight processor 1003 according to the processed image signal. The backlight processor 1003 is configured to determine a duty cycle and current data of a corresponding pulse width modulation (PWM) signal according to each zoned backlight value, and output the duty cycle and the current data of the corresponding PWM signal to the PWM driver. The PWM driver 1004 is configured to generate a PWM control signal to control a backlight source of a corresponding backlight zone. Wherein, so as to perform data processing on the obtained image signal, the processor 1002 is further configured to: determine a backlight adjustment rule according to a grayscale value distribution of the image signal and a first preset rule; determine a zoned image data block according to the image signal and a preset division rule, determine the zoned backlight value corresponding to the zoned image data block according to a grayscale value of the zoned image data block; and adjust the zoned backlight value according to the backlight adjustment rule to obtain an adjusted zoned backlight value; wherein a grayscale value distribution of the image signal represents a grayscale value distribution of pixels of the image signal, the first preset rule includes a corresponding relationship between the grayscale value distribution and the backlight adjustment rule, and the backlight adjustment rule is a corresponding relationship between the backlight value and an adjustment coefficient.

Optionally, the memory 1001 is further configured to store various types of data of preset lookup table, and the processor 1002 is further configured to execute the instructions in the memory for calling the various types of the data of the lookup table.

The liquid crystal display device provided by the present application can carry out the technical solutions of any method embodiments as described above, the realization principle and the technical effect of which are similar and will not be repeated herein.

Those skilled in the art may understand that all or part of the steps in the methods of the embodiments can be implemented by hardware under instructions. The instructions may be stored in a computer readable storage medium and when the instructions are executed, the steps in the methods of the embodiments are performed. The storage medium may be any medium that can store a program code, including a read-only memory (ROM), a random access memory (RAM), a floppy disk, or an optical disk, etc.

Finally, it should be noted that the foregoing embodiments are merely intended for describing the technical solutions of the present application other than limiting the present application. Although the present application is described in detail with reference to the foregoing embodiments, persons of ordinary skill in the art should understand that they may still make modifications to the technical solutions described in the foregoing embodiments or make equivalent substitutions to some technical features thereof, without departing from the spirit and scope of the technical solutions of embodiments of the present application.

What is claimed is:

1. A method for controlling liquid crystal display brightness, comprising:

determining a backlight adjustment rule according to a grayscale value distribution of an image signal and a first preset rule;

determining a zoned image data block according to the image signal and a preset division rule, and determining a zoned backlight value corresponding to the zoned image data block according to a grayscale value of the zoned image data block;

adjusting the zoned backlight value according to the backlight adjustment rule to obtain an adjusted zoned backlight value; and mapping the adjusted zoned backlight value to a drive circuit of a backlight source of a corresponding backlight zone, so as to drive and control backlight source brightness of the corresponding backlight zone;

wherein the grayscale value distribution of the image signal represents a grayscale value distribution of pixels of the image signal, the first preset rule comprises a corresponding relationship between the grayscale value distribution and the backlight adjustment rule, and the backlight adjustment rule is a corresponding relationship between a backlight value and an adjustment coefficient for the backlight value.

2. The method according to claim 1, further comprising:

generating a grayscale histogram according to the grayscale value of the pixels of the image signal; and determining the grayscale value distribution of the image signal according to the grayscale histogram.

3. The method according to claim 2, wherein the generating the grayscale histogram according to the grayscale value of the pixels of the image signal comprises:

generating the grayscale histogram of the zoned image data block according to the grayscale value of pixels of the zoned image data block;

the determining the grayscale value distribution of the image signal according to the grayscale histogram of the image signal comprises:

determining the grayscale value distribution of the zoned image data block according to the grayscale histogram of the zoned image data block.

4. The method according to claim 2, wherein the determining the backlight adjustment rule according to the grayscale value distribution of the image signal and the first preset rule comprises:

generating a peripheral envelope curve of the grayscale histogram according to the grayscale histogram;

determining the backlight adjustment rule according to the peripheral envelope curve and the first preset rule.

5. The method according to claim 4, wherein the determining the backlight adjustment rule according to the peripheral envelope curve and the first preset rule comprises:

if the peripheral envelope curve is a forwarded S-shaped curve, then the adjustment coefficient corresponding to the backlight value of the high brightness is greater than 1, and the adjustment coefficient corresponding to the backlight value of the low brightness is smaller than 1;

if the peripheral envelope curve is an reversed S-shaped curve, then the adjustment coefficient corresponding to the backlight value of the low brightness is greater than 1, and the adjustment coefficient corresponding to the backlight value of the high brightness is smaller than 1; and if the peripheral envelope curve is a horizontal straight line, the adjustment coefficient corresponding to each backlight value is 1.

6. The method according to claim 1, wherein the determining the backlight adjustment rule according to the grayscale value distribution of the image signal and the first preset rule comprises:

if the grayscale value distribution of the zoned image data block is a distribution with more low grayscale values than high grayscale values, then an adjustment coefficient corresponding to the backlight value of low brightness is greater than 1, and an adjustment coefficient corresponding to the backlight value of high brightness is smaller than 1; and if the grayscale value distribution of the zoned image data block is a distribution with less low grayscale values than high grayscale values, then the adjustment coefficient corresponding to the backlight value of high brightness is greater than 1, and the adjustment coefficient corresponding to the backlight value of low brightness is smaller than 1.

7. An apparatus for controlling liquid crystal display brightness, comprising: a memory for storing instructions; and a processor coupled to the memory, the processor is configured to execute the instructions stored in the memory, and the processor is configured to:

determine a backlight adjustment rule according to a grayscale value distribution of an image signal and a first preset rule;

determine a zoned image data block according to the image signal and a preset division rule, and determine a zoned backlight value corresponding to the zoned image data block according to a grayscale value of the zoned image data block;

adjust the zoned backlight value according to the backlight adjustment rule to obtain an adjusted zoned backlight value; and map the adjusted zoned backlight value to a drive circuit of a backlight source of a corresponding backlight zone, so as to drive and control backlight source brightness of the corresponding backlight zone;

wherein the grayscale value distribution of the image signal represents a grayscale value distribution of pixels of the image signal, the first preset rule comprises a corresponding relationship between the grayscale value distribution and the backlight adjustment rule, and the backlight adjustment rule is a corresponding relationship between a backlight value and an adjustment coefficient for the backlight value.

8. The apparatus according to claim 7, wherein the processor is further configured to:

generate a grayscale histogram according to the grayscale value of the pixels of the image signal; and determine the grayscale value distribution of the image signal according to the grayscale histogram.

9. The apparatus according to claim 8, wherein the processor is configured to:

generate the grayscale histogram of the zoned image data block according to the grayscale value of pixels of the zoned image data block; and determine the grayscale value distribution of the zoned image data block according to the grayscale histogram of the zoned image data block.

10. The apparatus according to claim 8, wherein the processor is configured to:

generate a peripheral envelope curve of the grayscale histogram according to the grayscale histogram; and determine the backlight adjustment rule according to the peripheral envelope curve and the first preset rule.

11. The apparatus according to claim 10, wherein the processor is configured to:

if the peripheral envelope curve is a forwarded S-shaped curve, then the adjustment coefficient corresponding to the backlight value of the high brightness is greater than 1, and the adjustment coefficient corresponding to the backlight value of the low brightness is smaller than 1;

if the peripheral envelope curve is an reversed S-shaped curve, then the adjustment coefficient corresponding to the backlight value of the low brightness is greater than 1, and the adjustment coefficient corresponding to the backlight value of the high brightness is smaller than 1; and if the peripheral envelope curve is a horizontal straight line, the adjustment coefficient corresponding to each backlight value is 1.

12. The apparatus according to claim 7, wherein the processor is configured to:

if the grayscale value distribution of the zoned image data block is a distribution with more low grayscale values than high grayscale values, then an adjustment coefficient corresponding to the backlight value of low brightness is greater than 1, and an adjustment coefficient corresponding to the backlight value of high brightness is less than 1; and if the grayscale value distribution of the zoned image data block is a distribution with less low grayscale values than high grayscale values, then the adjustment coefficient corresponding to the backlight value of high brightness is greater than 1, and the adjustment coefficient corresponding to the backlight value of low brightness is smaller than 1.

13. A liquid crystal display device, comprising: a memory, a processor, a backlight processor, and a pulse width modulation (PWM) driver, wherein the memory, the processor, the backlight processor, and the PWM driver are connected via a bus; and wherein:

the memory is configured to store instructions;

the processor is configured to execute the instructions stored in the memory, and the processor is also configured to receive an image signal for data processing, output processed image data to a timing controller which generates a driving signal for controlling image displaying of a liquid crystal panel according to the processed image data, and output a zoned backlight value to a backlight processor according to the processed image signal;

the processor is further configured to:

determine a backlight adjustment rule according to a grayscale value distribution of the image signal and a first preset rule; determine a zoned image data block according to the image signal and a preset division rule, and determine a zoned backlight value corresponding to the zoned image data block according to a grayscale value of the zoned image data block; adjust the zoned backlight value according to the backlight adjustment rule, to obtain an adjusted zoned backlight value; and map the adjusted zoned backlight value to a drive circuit of a backlight source of a corresponding backlight zone, so as to drive and control backlight source brightness of the corresponding backlight zone; wherein the grayscale value distribution of the image signal represents a grayscale value distribution of pixels of the image signal, the first preset rule comprises a corresponding relationship between the grayscale value distribution and the backlight adjustment rule, and the backlight adjustment rule is a corresponding relationship between a backlight value and an adjustment coefficient for the backlight value;

the backlight processor is configured to determine, according to each zoned backlight value, a duty cycle and current data of a corresponding PWM signal, and output the duty cycle and the current data of the corresponding PWM signal to the PWM driver; and the PWM driver is configured to generate a PWM control signal to control a backlight source of a corresponding backlight zone.

14. The device according to claim 13, wherein the memory is further configured to store data of various types of preset lookup tables; and the processor is further configured to execute the instructions in the memory for calling the data of the various types of preset lookup tables.

* * * * *